US011143477B1

(12) United States Patent
Oglesby

(10) Patent No.: US 11,143,477 B1
(45) Date of Patent: Oct. 12, 2021

(54) LOCKABLE MUZZLE DEVICE MOUNTING SYSTEM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 15/930,543

(22) Filed: May 13, 2020

Related U.S. Application Data

(60) Provisional application No. 62/847,213, filed on May 13, 2019.

(51) Int. Cl.
*F41A 21/32* (2006.01)
*F41A 21/36* (2006.01)

(52) U.S. Cl.
CPC ..... *F41A 21/325* (2013.01); *F41A 21/36* (2013.01)

(58) Field of Classification Search
CPC ..... F41A 21/30; F41A 21/32; F41A 21/325; F41A 21/34; F41A 21/36; F41A 21/38; F41A 21/40; F41A 21/42
USPC ..... 89/14.2–14.6
See application file for complete search history.

(56) References Cited

U.S. PATENT DOCUMENTS

| | | | | |
|---|---|---|---|---|
| 5,333,529 | A * | 8/1994 | Brockman | F41A 21/38 42/79 |
| 5,509,345 | A * | 4/1996 | Cyktich | F41A 21/325 42/97 |
| 7,353,740 | B1 * | 4/2008 | Hoffman | F41A 21/26 42/107 |
| 8,291,805 | B1 * | 10/2012 | Quilligan | F41A 21/325 89/14.2 |
| 8,997,621 | B1 * | 4/2015 | Dater | F41A 21/32 89/14.3 |
| 9,377,263 | B1 * | 6/2016 | Sy | F41A 21/36 |
| 9,513,078 | B1 * | 12/2016 | Fulton | F41A 21/30 |
| 10,234,230 | B1 * | 3/2019 | Oglesby | F41A 21/325 |
| 10,641,573 | B2 * | 5/2020 | Jen | F41A 21/36 |
| 10,845,150 | B1 * | 11/2020 | Oglesby | F41A 21/34 |
| 2014/0237881 | A1 * | 8/2014 | Mack | F41A 21/325 42/90 |
| 2018/0245872 | A1 * | 8/2018 | Jen | F41A 21/325 |

* cited by examiner

*Primary Examiner* — Jonathan C Weber
(74) *Attorney, Agent, or Firm* — Shaddock Law Group, PC

(57) ABSTRACT

A muzzle device mounting system having a muzzle device having muzzle device locking lug recesses; a locking collar having locking collar locking lug recesses and being rotatable relative to the muzzle device between a locked position and an unlocked position; and a pin extending from the locking collar and into at least a portion of the pin channel to limit rotational movement of the locking collar relative to the muzzle device, wherein if the locking collar is in the unlocked position, the muzzle device locking lug recesses are aligned with the locking collar locking lug recesses and if the locking collar is in the locked position, the muzzle device locking lug recesses are not aligned with the locking collar locking lug recesses.

20 Claims, 17 Drawing Sheets

LOCKABLE MUZZLE DEVICE MOUNTING SYSTEM

CROSS-REFERENCE TO RELATED APPLICATIONS

This patent application claims the benefit of U.S. Patent Application No. 62/847,213, filed May 13, 2019, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a lockable muzzle device mounting system for a firearm.

2. Description of Related Art

A muzzle brake is a device that is attached to the terminal end of a muzzle of a firearm that redirects propellant gases to counter recoil and unwanted barrel rise that normally occurs during the normal firing sequence. Muzzle brakes or other devices are typically attached to a firearm barrel via interaction between internal threads of the muzzle device and external threads at the muzzle end of the barrel.

During normal operation of a firearm, and particularly a rifle, when a round is fired, gas from the burning propellant forces the bullet through the barrel. As the bullet travels down and out of the barrel, the bullet and the propellant gases act on barrel, along the longitudinal axis, or centerline, of the barrel, to produce a recoil force. Because of the difference between the longitudinal axis of the barrel and the average point of contact between the firearm and the user (the average point where the user resists the recoil force), the muzzle end of the firearm's barrel rotates upward.

Muzzle brakes typically utilize one or more slots, vents, holes, and/or baffles to divert and/or redirect the propellant gases as they leave the barrel. Generally, muzzle brakes divert and/or redirect the propellant gases horizontally (left and right), at some angle that is substantially perpendicular to the longitudinal axis of the barrel.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, there is no current design that allows for the fast and repeatable attachment of a device (i.e., muzzle device, suppressor, etc.) to a barrel in a manner that ensures correct and repeatable timing of the device relative to the barrel.

These and other disadvantages and shortcomings of the prior art are overcome by the features and elements of the lockable muzzle device mounting system of the present disclosure. In various exemplary, nonlimiting embodiments, the lockable muzzle device mounting system of the present disclosure includes a locking collar and a muzzle device. The locking collar is rotatably lockable relative to the muzzle device. Captured within at least a portion of the muzzle device are two tension elements and two ball elements. On the locking collar, there are a series of collar detents along the muzzle end of the locking collar face that provide tactile rotatable locking positions between the locked and unlocked positions.

Various exemplary embodiments, the depth of the collar detents varies. The larger or deeper of the collar detents are positioned relative to the ultimate locked and unlocked positions. These positions will give the user the greatest tactile feel. The smaller or more shallow collar detents, positioned in between the two larger or deeper collar detents, provide tactile clicking points between the ultimate locked and unlocked positions.

A pin aperture is formed through the barrel end of the locking collar. The pin aperture allows for installation of a pin (such as, for example, a 1/16×0.250" pin) through and extending from the pin aperture. The pin extends from the barrel end through the collar shoulder of the locking collar and into the collar recess of the locking collar. The pin is positioned to ride within a pin channel to stop additional rotation of the locking collar, beyond the ultimate locked and unlocked positions. In various exemplary embodiments, the pin channel is milled into at least a portion of one of the muzzle device capture extensions that extend from the muzzle device.

When the locking collar is in the unlocked position, lug recesses formed in the muzzle device align with lug recesses formed in the locking collar, to allow the flanges of the locking lug to be positioned within a locking lug recess of the muzzle device mounting system. Once appropriately positioned, the locking collar can be rotated to the locked position, wherein the lug recesses formed in the locking collar maintain the flanges of the locking lug within the locking lug recess of the muzzle device mounting system.

One or more holes or port apertures are formed through the muzzle device, so as to line up with muzzle devices designed for use in conjunction with the lockable muzzle device mounting system. The port apertures may be threaded or unthreaded.

The advantages of the present disclosure are optionally attained by providing, in certain exemplary, nonlimiting embodiments, a muzzle device mounting system, comprising a muzzle device having muzzle device locking lug recesses and having at least one ball detent recess formed in a portion of the muzzle device, wherein a tension element and a ball element are at least partially positioned within the at least one ball detent recess, and wherein a pin channel is formed within a portion of the muzzle device; a locking collar having locking collar locking lug recesses and being rotatable relative to the muzzle device between a locked position and an unlocked position, wherein the locking collar includes a plurality of collar detents formed in a surface of the locking collar, wherein the collar detents are formed so as to interact with the at least one ball element; and a pin extending from the locking collar and into at least a portion of the pin channel to limit rotational movement of the locking collar relative to the muzzle device, wherein if the locking collar is in the unlocked position, the muzzle device locking lug recesses are aligned with the locking collar locking lug recesses and if the locking collar is in the locked position, the muzzle device locking lug recesses are not aligned with the locking collar locking lug recesses.

In various exemplary, nonlimiting embodiments, the pin channel is an arcuate or partially arcuate pin recess or channel.

In various exemplary, nonlimiting embodiments, the collar detents provide tactile rotatable locking positions between the locked and unlocked positions.

In various exemplary, nonlimiting embodiments, a depth of at least some of the plurality of collar detents varies compared to a depth of at least some other of the plurality of collar detents.

In various exemplary, nonlimiting embodiments, larger or deeper collar detents are positioned relative to the locked and unlocked positions.

In various exemplary, nonlimiting embodiments, the muzzle device mounting system further comprises a plurality of port apertures formed through a portion of the muzzle device.

In various exemplary, nonlimiting embodiments, the muzzle device mounting system further comprises a plurality of port apertures extending radially from a muzzle device aperture of the muzzle device, toward the outer surface of the muzzle device.

In various exemplary, nonlimiting embodiments, the presently disclosed muzzle device mounting system comprises at least some of a muzzle device having muzzle device locking lug recesses having a tension element and a ball element at least partially positioned within at least one ball detent recess, and having a pin channel formed within a portion of the muzzle device; a locking collar having locking collar locking lug recesses and being rotatable relative to the muzzle device between a locked position and an unlocked position, the locking collar having a plurality of collar detents formed in a surface of the locking collar, having the collar detents formed so as to interact with the at least one ball element; and a pin extending from the locking collar and extending into at least a portion of the pin channel to limit rotational movement of the locking collar relative to the muzzle device, such that if the locking collar is in the unlocked position, the muzzle device locking lug recesses are aligned with the locking collar locking lug recesses and if the locking collar is in the locked position, the muzzle device locking lug recesses are not aligned with the locking collar locking lug recesses.

In various exemplary, nonlimiting embodiments, the pin channel is an arcuate or partially arcuate pin recess or channel.

In various exemplary, nonlimiting embodiments, the collar detents provide tactile rotatable locking positions between the locked and unlocked positions.

In various exemplary, nonlimiting embodiments, the pin comprises a cylindrical pin, a cylindrical pin dowel, a roll pin, a tension pin, a split pin, or an expansion pin.

In various exemplary, nonlimiting embodiments, larger or deeper collar detents are positioned relative to the locked and unlocked positions.

In various exemplary, nonlimiting embodiments, the muzzle device mounting system further comprises a plurality of port apertures formed through a portion of the muzzle device.

In various exemplary, nonlimiting embodiments, the muzzle device mounting system further comprises a plurality of port apertures extending radially from a muzzle device aperture of the muzzle device, toward the outer surface of the muzzle device.

In various exemplary, nonlimiting embodiments, the presently disclosed muzzle device mounting system comprises at least some of a muzzle device having muzzle device locking lug recesses having at least one ball detent recess, the at least one ball detent recess having a tension element and a ball element at least partially positioned therein, and having a pin channel formed within a portion of the muzzle device; a locking collar having locking collar locking lug recesses and being rotatable relative to the muzzle device between a locked position and an unlocked position, the locking collar having a plurality of collar detents formed in a surface of the locking collar, having the collar detents formed so as to allow at least a portion of the at least one ball element to be selectively and removably positioned within at least a portion of at least one of the collar detents; and a pin extending from the locking collar and extending into at least a portion of the pin channel to bound rotational movement of the locking collar relative to the muzzle device, such that if the locking collar is in the unlocked position, the muzzle device locking lug recesses are aligned with the locking collar locking lug recesses.

In various exemplary, nonlimiting embodiments, if the locking collar is in the locked position, the muzzle device locking lug recesses are not aligned with the locking collar locking lug recesses.

In various exemplary, nonlimiting embodiments, the pin comprises a cylindrical pin, a cylindrical pin dowel, a roll pin, a tension pin, a split pin, or an expansion pin.

In various exemplary, nonlimiting embodiments, larger or deeper collar detents are positioned relative to the locked and unlocked positions.

In various exemplary, nonlimiting embodiments, the muzzle device mounting system further comprises a plurality of port apertures formed through a portion of the muzzle device.

In various exemplary, nonlimiting embodiments, the pin channel is an arcuate or partially arcuate pin recess or channel.

Accordingly, the presently disclosed systems, methods, and/or apparatuses provide a lockable muzzle device mounting system that allows for the removable attachment or coupling of a muzzle device to a locking lug.

The presently disclosed systems, methods, and/or apparatuses separately provide a lockable muzzle device mounting system that can be quickly and easily manipulated by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
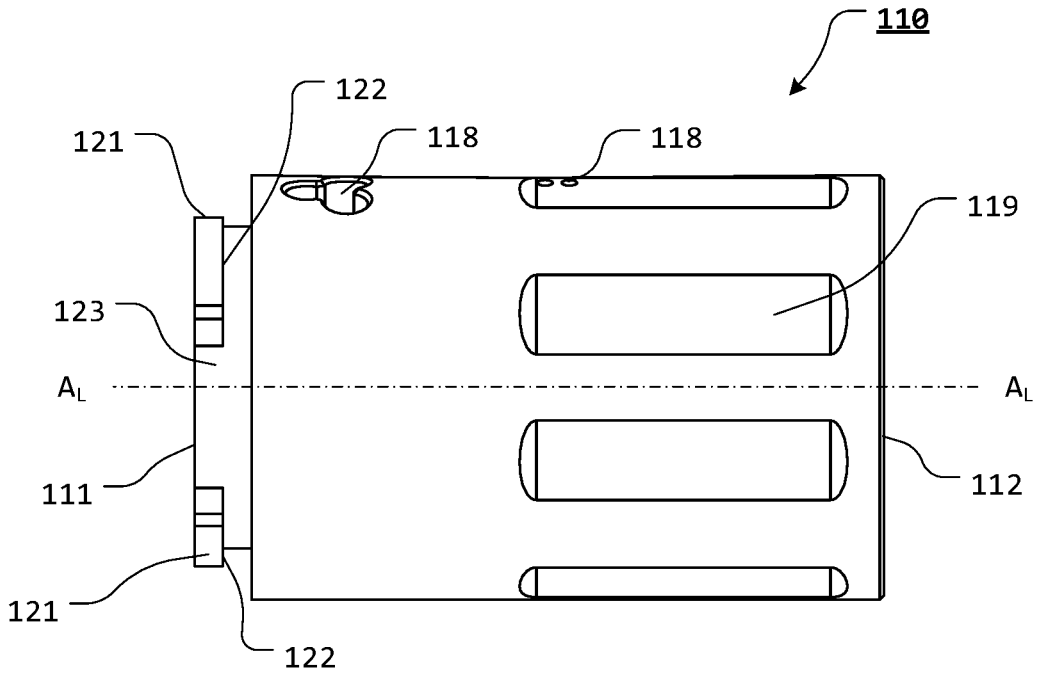
FIG. 1 illustrates a right side view of an exemplary embodiment of a muzzle device, according to the presently disclosed systems, methods, and/or apparatuses.
Figure 2:
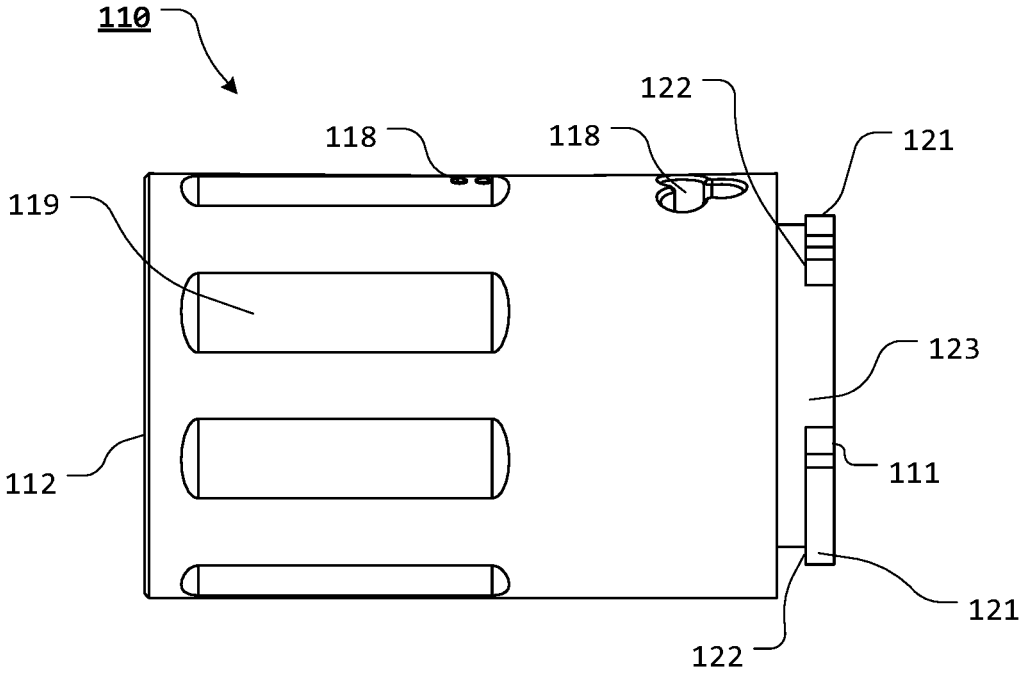
FIG. 2 illustrates a left side view of an exemplary embodiment of a muzzle device, according to the presently disclosed systems, methods, and/or apparatuses.
Figure 3:
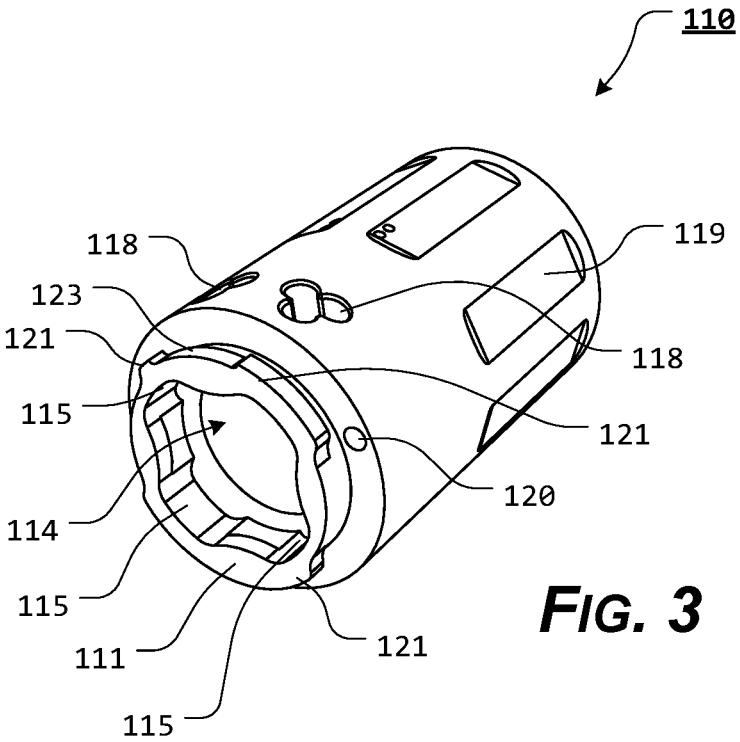
FIG. 3 illustrates an upper, rear, right perspective view of an exemplary embodiment of a muzzle device, according to the presently disclosed systems, methods, and/or apparatuses.
Figure 4:
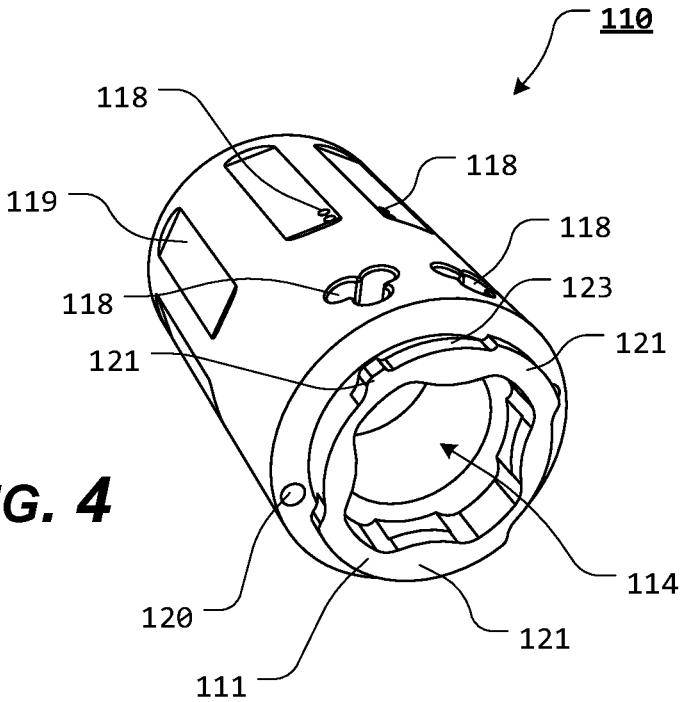
FIG. 4 illustrates an upper, rear, left perspective view of an exemplary embodiment of a muzzle device, according to the presently disclosed systems, methods, and/or apparatuses.
Figure 5:
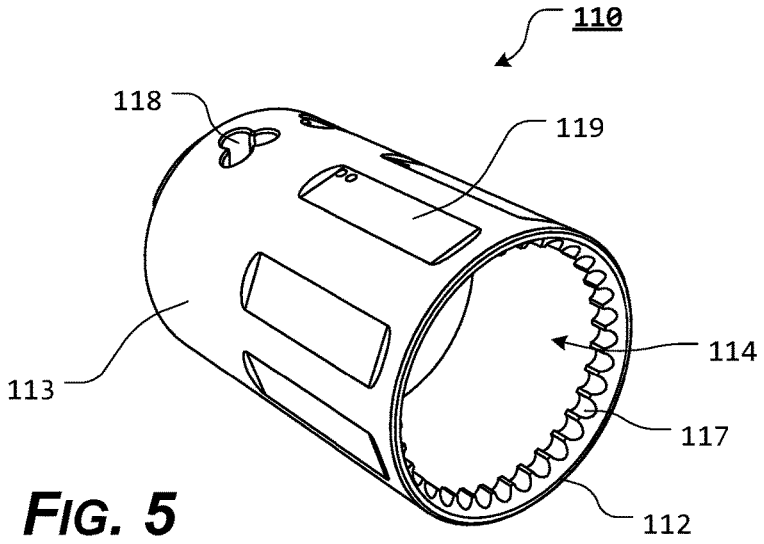
FIG. 5 illustrates an upper, front, right perspective view of an exemplary embodiment of a muzzle device, according to the presently disclosed systems, methods, and/or apparatuses.
Figure 6:
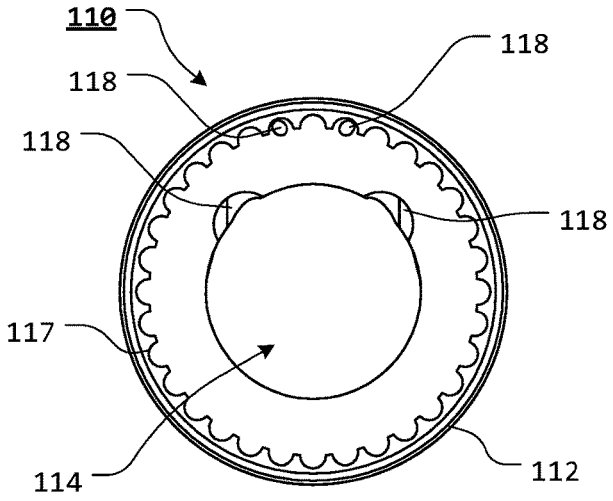
FIG. 6 illustrates a front view of an exemplary embodiment of a muzzle device, according to the presently disclosed systems, methods, and/or apparatuses.
Figure 7:
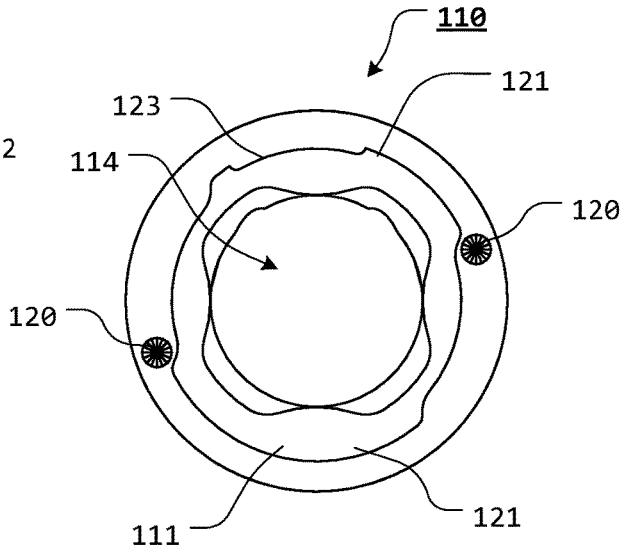
FIG. 7 illustrates a rear view of an exemplary embodiment of a muzzle device, according to the presently disclosed systems, methods, and/or apparatuses.
Figure 8:
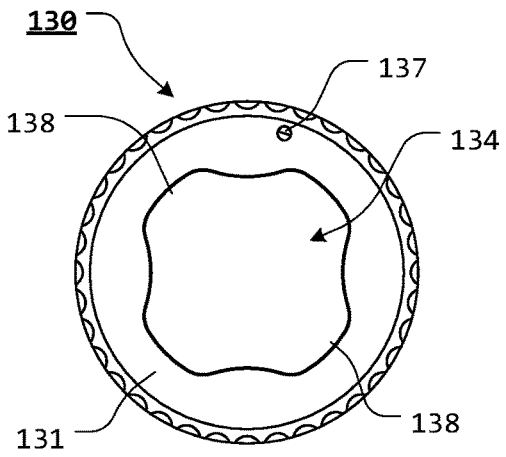
FIG. 8 illustrates a rear view of an exemplary embodiment of a locking collar, according to the presently disclosed systems, methods, and/or apparatuses.
Figure 9:
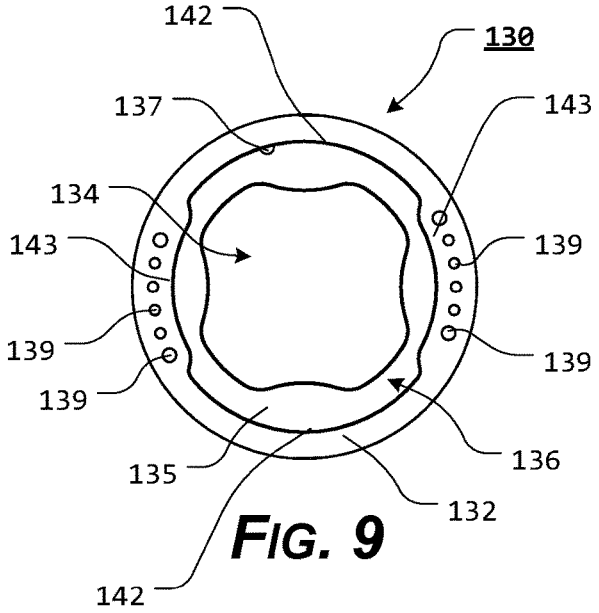
FIG. 9 illustrates a front view of an exemplary embodiment of a locking collar, according to the presently disclosed systems, methods, and/or apparatuses.
Figure 10:
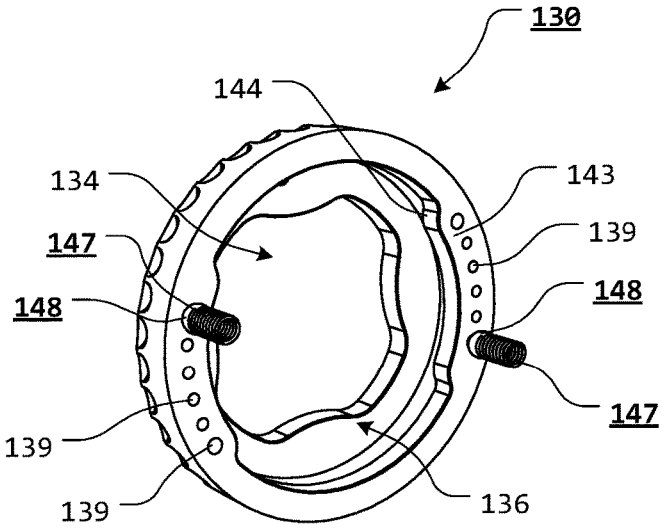
FIG. 10 illustrates a front perspective view of an exemplary embodiment of a locking collar, according to the presently disclosed systems, methods, and/or apparatuses.
Figure 11:
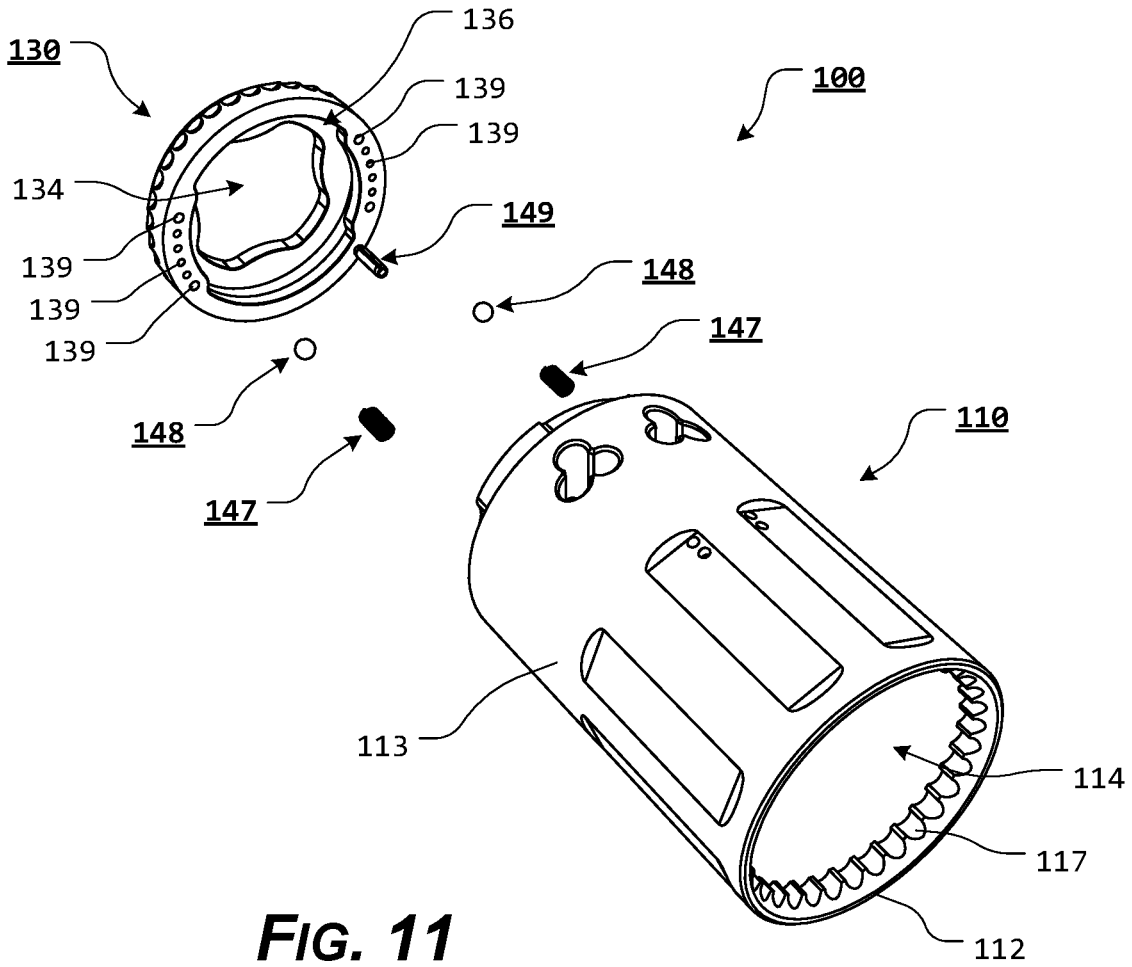
FIG. 11 illustrates an exploded, front perspective view of an exemplary embodiment of a lockable muzzle device mounting system, according to the presently disclosed systems, methods, and/or apparatuses.
Figure 12:
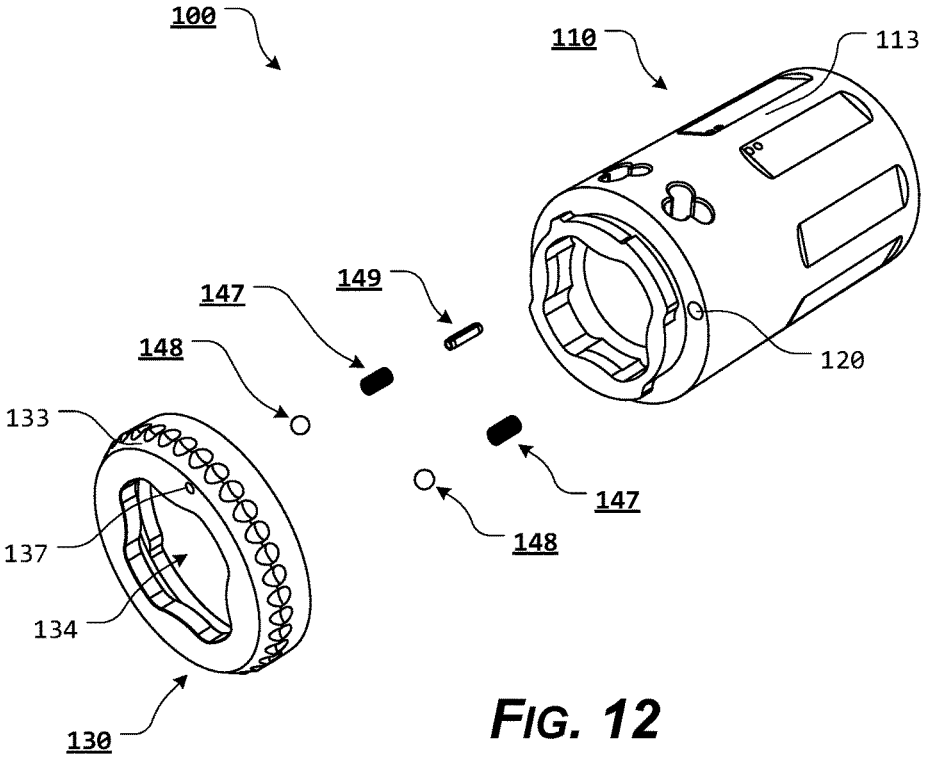
FIG. 12 illustrates an exploded, rear perspective view of an exemplary embodiment of a lockable muzzle device mounting system, according to the presently disclosed systems, methods, and/or apparatuses.
Figure 13:
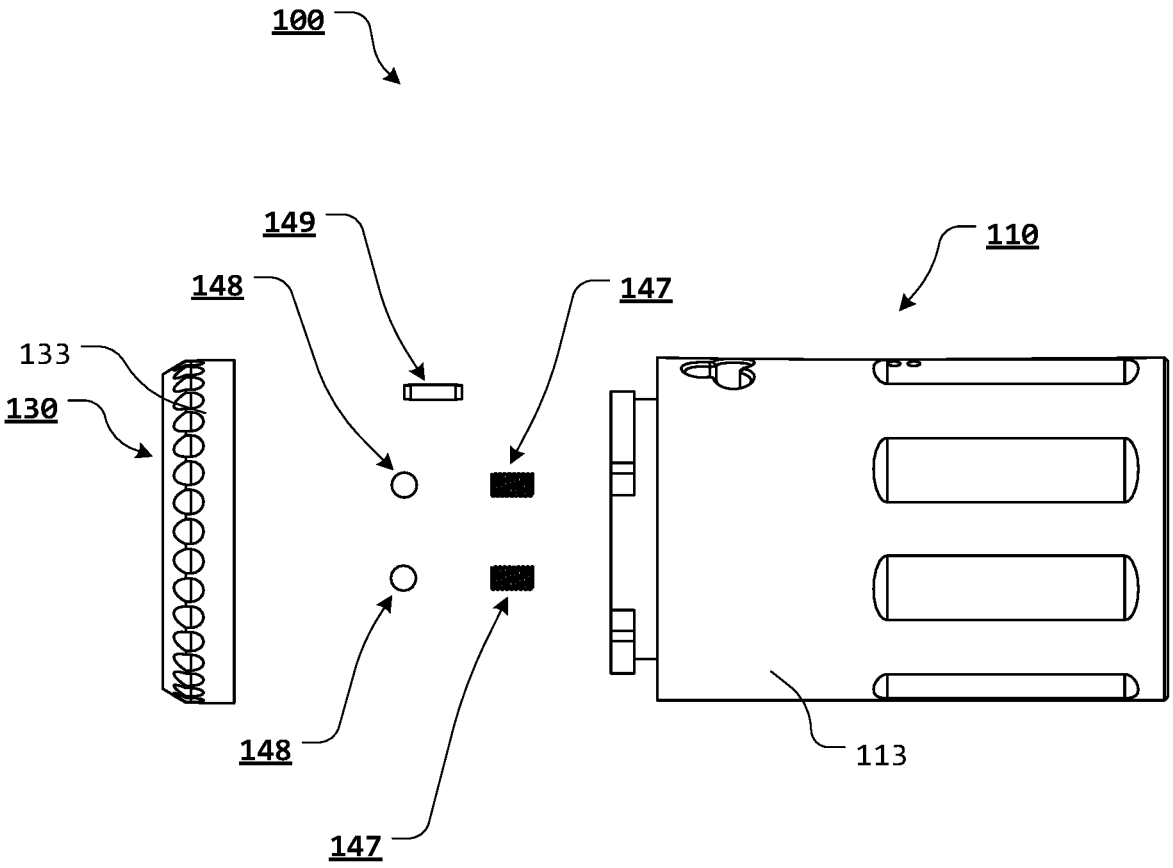
FIG. 13 illustrates an exploded, right side view of an exemplary embodiment of a lockable muzzle device mounting system, according to the presently disclosed systems, methods, and/or apparatuses.
Figure 14:
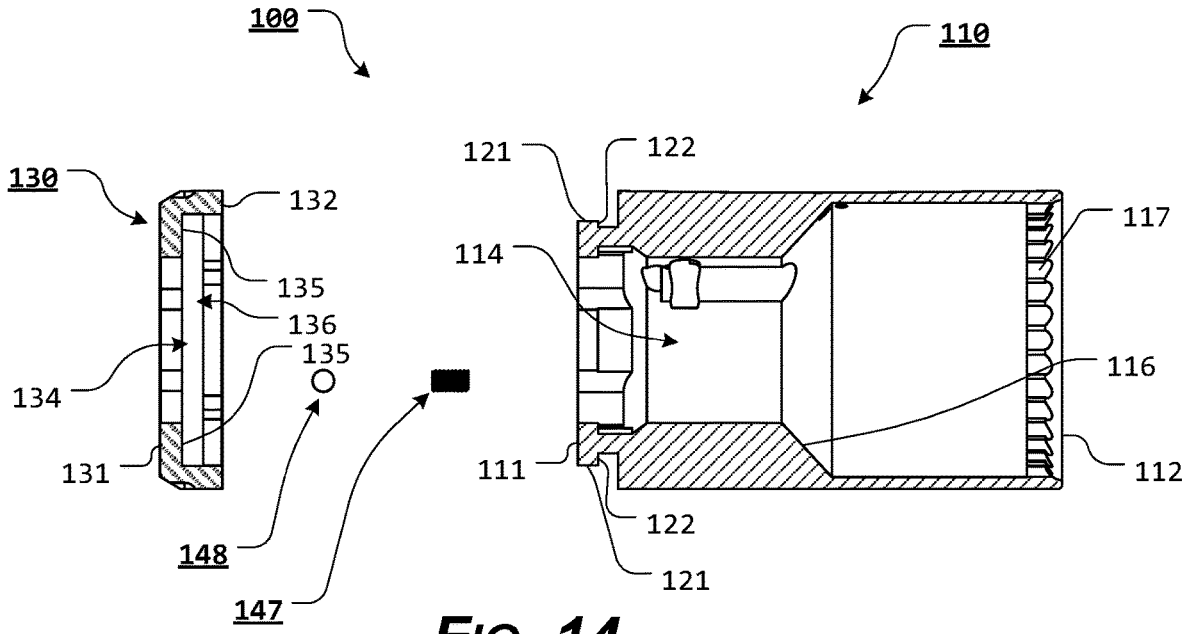
FIG. 14 illustrates an exploded, cross-sectional view of an exemplary embodiment of a lockable muzzle device mounting system, according to the presently disclosed systems, methods, and/or apparatuses.
Figure 15:
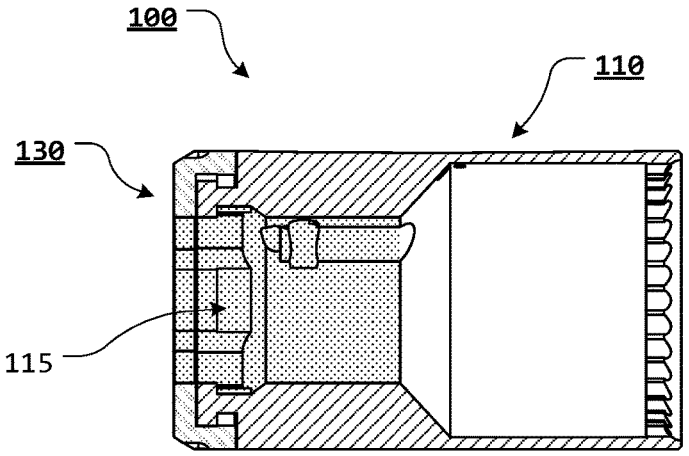
FIG. 15 illustrates a side, cross-sectional view of an exemplary embodiment of a lockable muzzle device mounting system, according to the presently disclosed systems, methods, and/or apparatuses.
Figure 16:
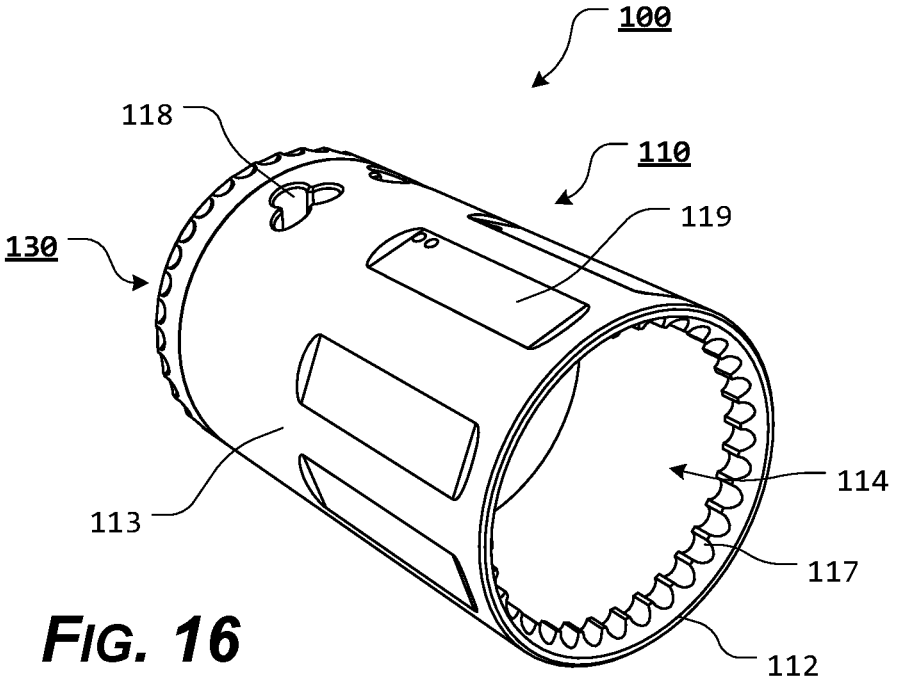
FIG. 16 illustrates an upper, right, front, perspective view of an exemplary embodiment of a lockable muzzle device mounting system, according to the presently disclosed systems, methods, and/or apparatuses.
Figure 17:
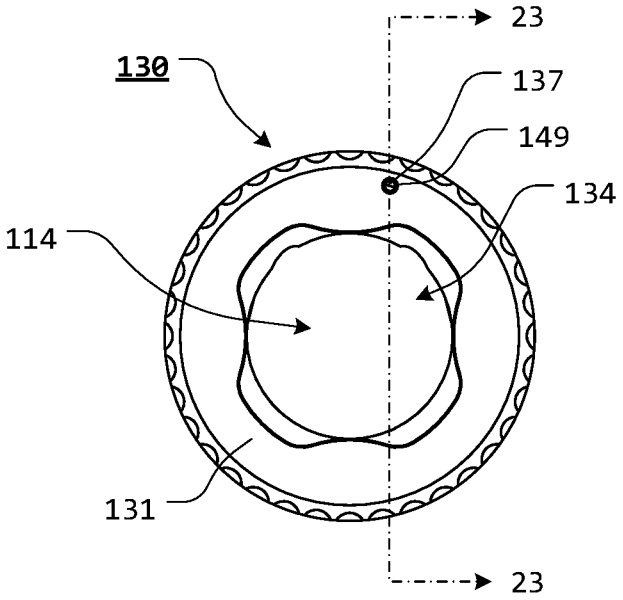
FIG. 17 illustrates a rear view of an exemplary embodiment of a lockable muzzle device mounting system, according to the presently disclosed systems, methods, and/or apparatuses.
Figure 18:
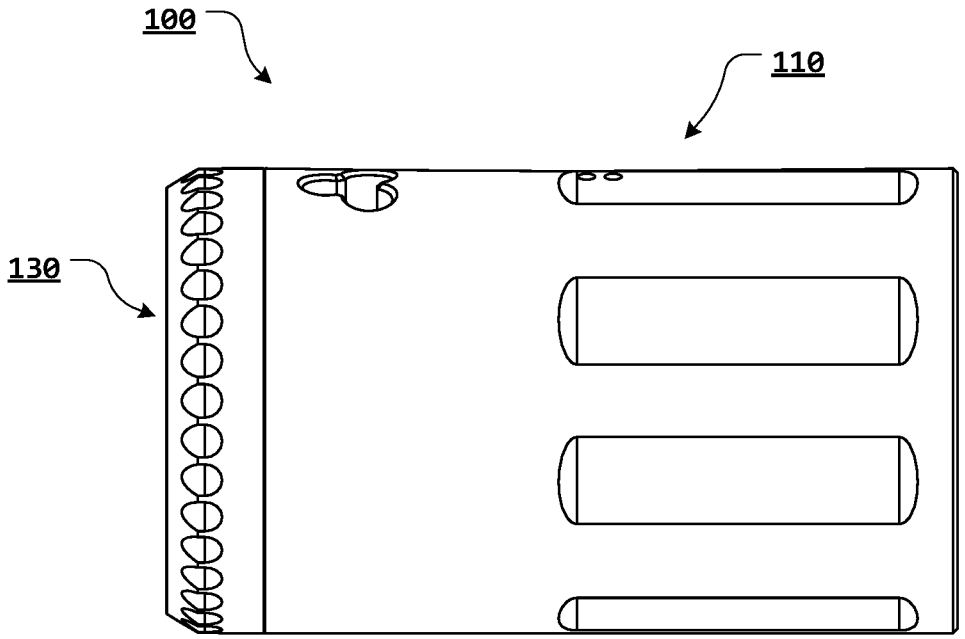
FIG. 18 illustrates a right side view of an exemplary embodiment of a lockable muzzle device mounting system, according to the presently disclosed systems, methods, and/or apparatuses.
Figure 19:
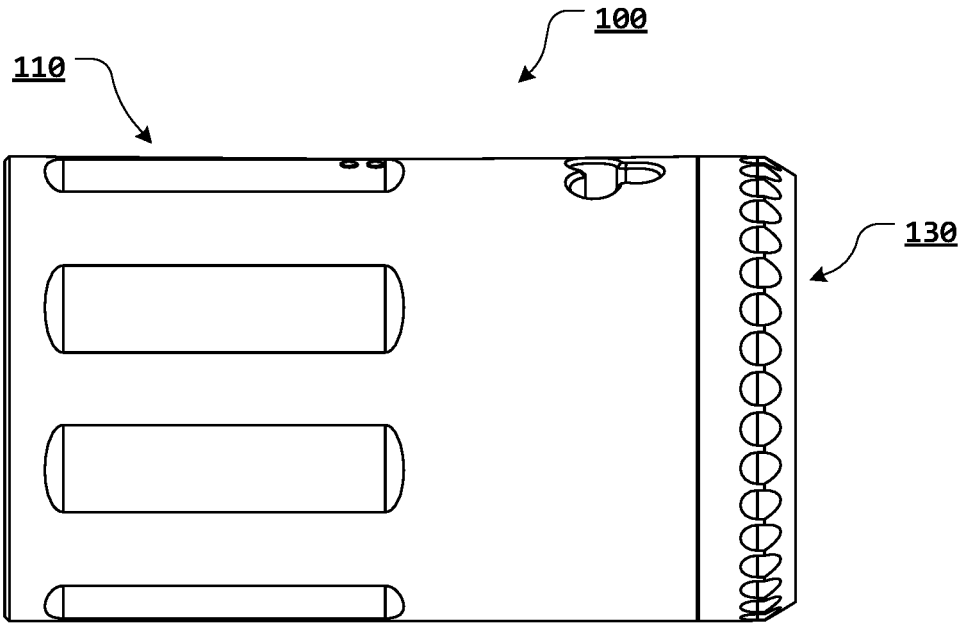
FIG. 19 illustrates a left side view of an exemplary embodiment of a lockable muzzle device mounting system, according to the presently disclosed systems, methods, and/or apparatuses.
Figure 20:
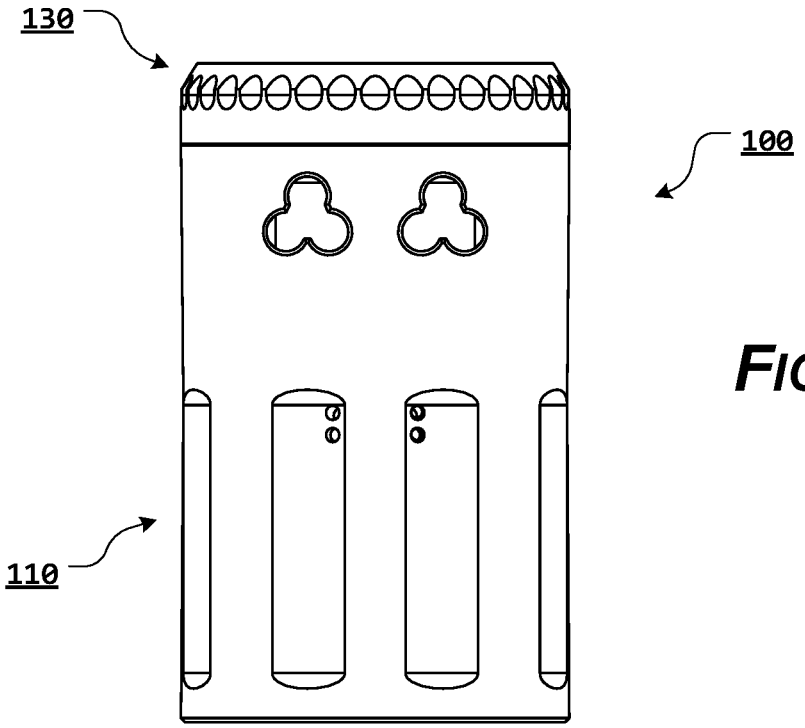
FIG. 20 illustrates a top view of an exemplary embodiment of a lockable muzzle device mounting system, according to the presently disclosed systems, methods, and/or apparatuses.
Figure 21:
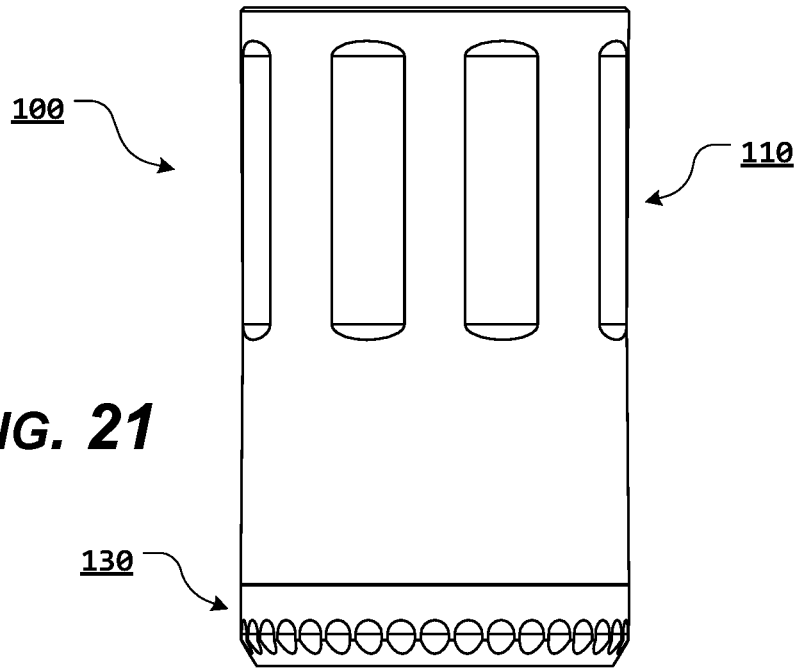
FIG. 21 illustrates a bottom view of an exemplary embodiment of a lockable muzzle device mounting system, according to the presently disclosed systems, methods, and/or apparatuses.
Figure 22:
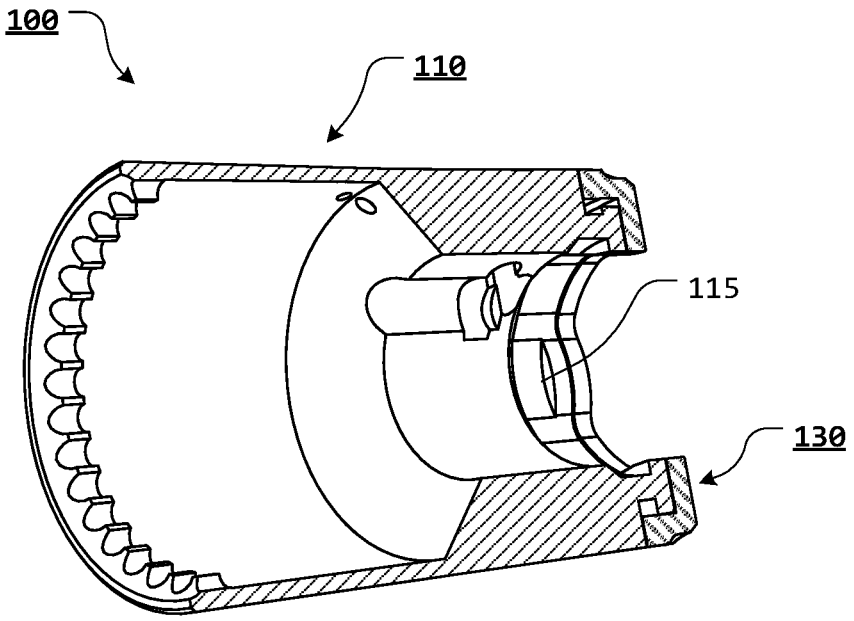
FIG. 22 illustrates a cross-sectional view of an exemplary embodiment of a lockable muzzle device mounting system, according to the presently disclosed systems, methods, and/or apparatuses.
Figure 23:
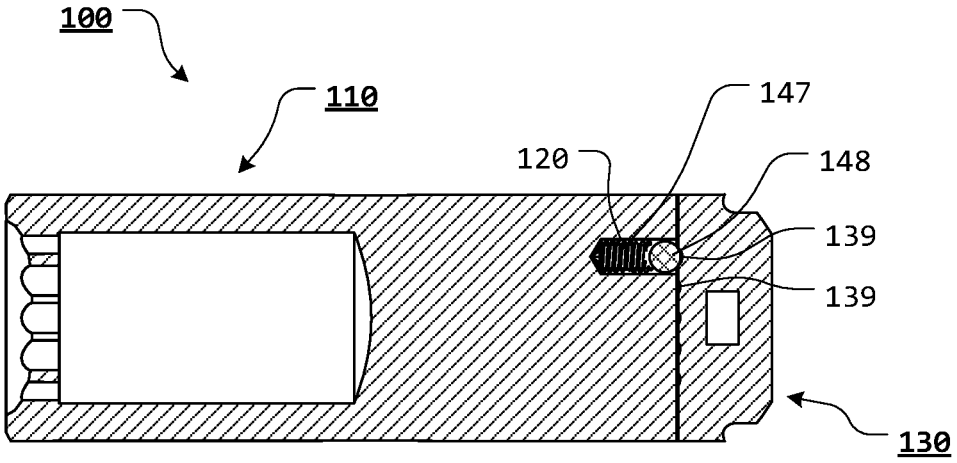
FIG. 23 illustrates a cross-sectional view, taken along line 23-23 of FIG. 17, of an exemplary embodiment of a lockable muzzle device mounting system, according to the presently disclosed systems, methods, and/or apparatuses.
Figure 24:
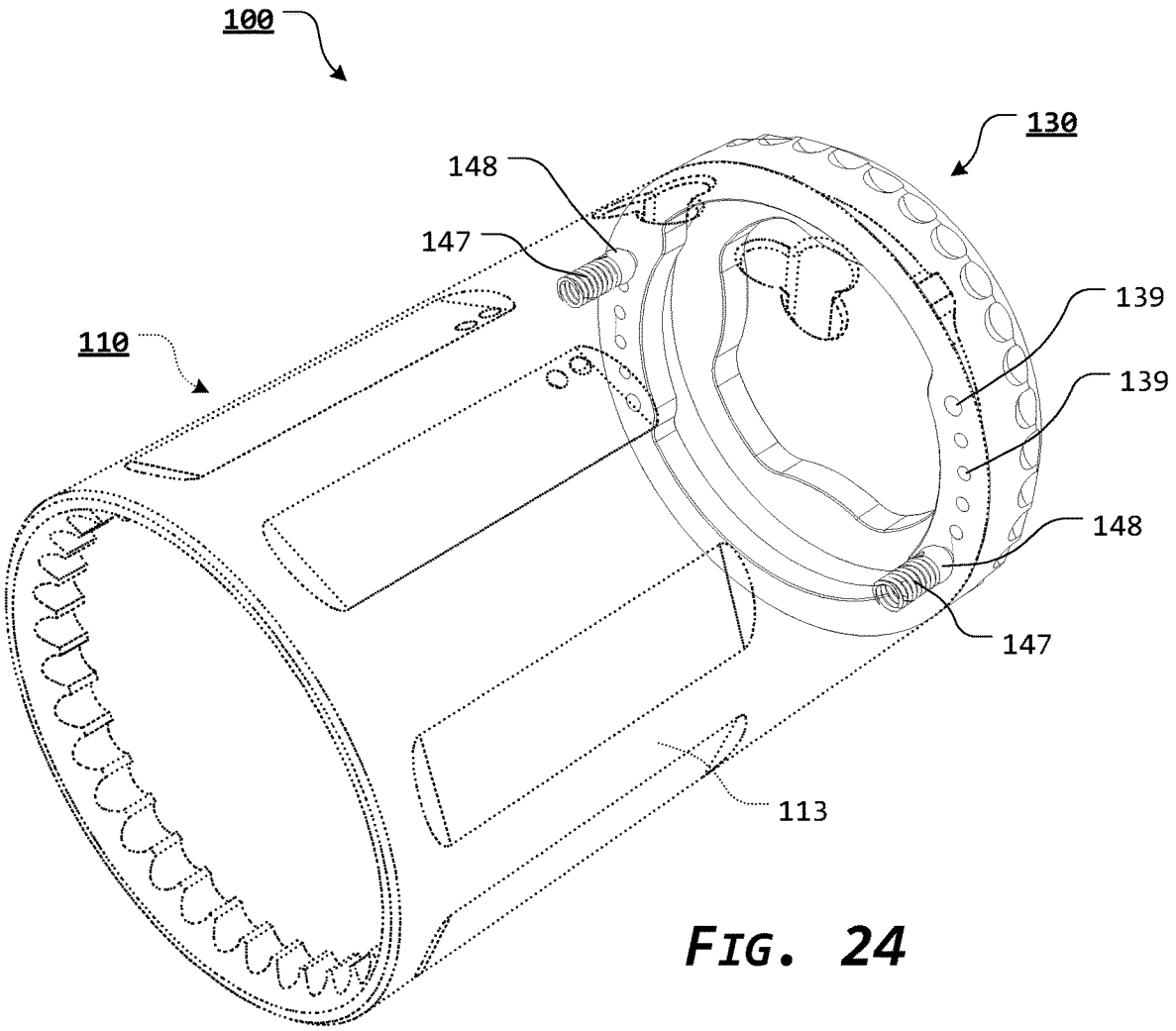
FIG. 24 illustrates a left, front, upper, perspective view of an exemplary embodiment of a lockable muzzle device mounting system, according to the presently disclosed systems, methods, and/or apparatuses.

For simplicity and clarification, the design factors and operating principles of the lockable muzzle device mounting system according to the presently disclosed systems, methods, and/or apparatuses are explained with reference to various exemplary embodiments of a lockable muzzle device mounting system according to the presently disclosed systems, methods, and/or apparatuses. The basic explanation of the design factors and operating principles of the lockable muzzle device mounting system is applicable for the understanding, design, and operation of the lockable muzzle device mounting system of the presently disclosed systems, methods, and/or apparatuses. It should be appreciated that the lockable muzzle device mounting system can be adapted to many applications where a lockable muzzle device mounting system or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "lockable muzzle device mounting system", "muzzle device", "locking collar", "locking lug", and "firearm" are used for basic explanation and understanding of the operation of the presently disclosed systems, methods, and/or apparatuses. Therefore, the terms "lockable muzzle device mounting system", "muzzle device", "locking collar", "locking lug", and "firearm" are not to be construed as limiting the systems, methods, and/or apparatuses of the present disclosure. Thus, for example, the term "locking lug" is to be understood to broadly include any length pistol or rifle barrel for a firearm or other similar handheld or shoulder mounted device or tool.

For simplicity and clarification, the lockable muzzle device mounting system of the present disclosure will be described as being used in conjunction with a barrel locking lug. However, it should be appreciated that these are merely exemplary embodiments of the lockable muzzle device mounting system and are not to be construed as limiting the presently disclosed systems, methods, and/or apparatuses. Thus, the lockable muzzle device mounting system of the present disclosure may be utilized in conjunction with any barrel extension, lug, or device.

Turning now to the drawing FIGS., FIG. 1-31 illustrate certain elements, components, and/or aspects of an exemplary embodiment of a lockable muzzle device 110 mounting system 100, according to the presently disclosed systems, methods, and/or apparatuses. In illustrative, non-limiting embodiment(s) of the present disclosure, the lockable muzzle device 110 mounting system 100 comprises at least some of a muzzle device 110, a locking collar 130, at least one tension element 147, and at least one ball element 148.

As illustrated most clearly in FIGS. 1-7 and 14, the muzzle device 110 extends from a barrel end 111 to a muzzle end 112. A muzzle device aperture 114 extends from the barrel end 111 to the muzzle end 112. A locking lug recess 115 is formed within at least a portion of the muzzle device aperture 114. The locking lug recess 115 is formed so as to receive at least a portion of a barrel locking lug therein.

In certain exemplary embodiments, as the muzzle device aperture 114 extends from the locking lug recess 115, a tapered wall portion 116 extends toward the muzzle end 112 of the muzzle device 110.

The muzzle device aperture 114 extends to the open muzzle end 112. In various exemplary embodiments, interruption elements 117 are formed within at least a portion of the muzzle device aperture 114. In various exemplary embodiments, the interruption elements 117 comprise a plurality of spaced apart, at least partially cylindrical relief cuts.

The muzzle device 110 optionally includes a series of apertures or port apertures 118 drilled or otherwise formed with tapered or straight holes formed through a portion of the muzzle device body 103 of the muzzle device 110. In various exemplary embodiments, the port apertures 118 extend radially from the muzzle device aperture 114, toward the outer surface of the muzzle device body 103. If the port apertures 118 are tapered, they may optionally be tapered outward as they extend from the muzzle device aperture 114 or may be tapered inward as they extend from the muzzle device aperture 114. Each of the mitigation port apertures 118 provides fluid communication between at least a portion of the muzzle device aperture 114 and the exterior of the muzzle device 110.

In certain exemplary, nonlimiting embodiments, the port apertures 118 are arranged in a triangular or square grid pattern in an upper portion of the muzzle device 110. By incorporating a plurality of port apertures 118, instead of one large aperture on each side of the muzzle device 110, the propellant gases exiting the muzzle device aperture 114 are disrupted as they exit through the port apertures 118 and into the environment surrounding the muzzle device 110.

It should be appreciated that the muzzle device apertures 114 may optionally comprise threaded or at least partially threaded apertures. Alternatively, an inner portion of each muzzle device aperture 114 may be textured. By threading or texturing at least a portion of the muzzle device apertures 114, the muzzle device apertures 114 provide a rougher internal surface to further breakup or interrupt the flow of propellant gases as the propellant gases move through the muzzle device aperture 114.

In various exemplary embodiments, parallel flats 119 may be provided on portions of the muzzle device body 103. The flats 119 provide parallel surfaces for a wrench or other installation device to grip the muzzle device 110.

One or more ball detent recesses 120 are formed proximate the barrel end 111 of the muzzle device 110. The ball detent recesses 120 are formed so as to allow at least a portion of a tension element 147 and ball element 148 to be positioned within each ball detent recess 120. The tension element 147, such as a coil spring, is positioned within each ball detent recess 120. A spherical ball element 148 is then positioned atop the tension element 147, such that at least a portion of the ball element 148 extends from the ball detent recess 120.

The ball element 148 is a single, typically metal sphere, that is slidable within the ball detent recess 120, against the pressure of the tension element 147, which pushes the ball element 148 toward and against the muzzle end 132 of the locking collar 130.

In various exemplary embodiments, the ball element 148 and tension element 147 comprises a single element.

One or more muzzle device capture extensions 121 extend from the barrel end 111 of the muzzle device 110. A muzzle device capture shoulder 122 is formed by each muzzle device capture extension 121. A pin channel 123 is formed within at least a portion of at least one of the muzzle device capture extensions 121. In various exemplary embodiments, the pin channel 123 is an arcuate or partially arcuate pin recess or channel. The pin channel 123 acts to stop rotation of the locking collar 130 beyond the ultimate locked and unlocked positions. In various exemplary embodiments, the pin channel 123 is milled into at least a portion of one of the muzzle device capture extensions 121 that extend from the muzzle device 110.

As illustrated most clearly in FIGS. 8-10 and 14, the locking collar 130 comprises a collar body 133, which extends from a barrel end 131 to a muzzle end 132. A collar aperture 134 is formed through the locking collar 130. In various exemplary embodiments, the collar aperture 134 has a first inner diameter as the collar aperture 134 extends from the muzzle end 132, toward the barrel end 131. A collar shoulder 135 is formed within the collar aperture 134 and the collar aperture 134 has a second, smaller, inner diameter as the collar aperture 134 extends from the collar shoulder 135 to the barrel end 131. A collar recess 136 is formed by the collar aperture 134, between the muzzle end 132 and the collar shoulder 135.

Locking collar locking lug recesses 138 are formed within a portion of the collar aperture 134.

A series of collar detents 139 are formed along the muzzle end 132 of the face of the muzzle end 132 of the locking collar 130 that provide tactile rotatable locking positions between the locked and unlocked positions. Each collar detent 139, which may be as simple as a detent of smaller diameter than the associated ball element 148. When a collar detent 139 is in line with the ball detent recess 120, the ball element 148 falls partially into the collar detent 139 under spring pressure from the tension element 147, holding the locking collar 130 in a determined rotational position relative to the muzzle device 110. Additional rotational force applied to the locking collar 130 relative to the muzzle device 110 will urge the ball element 148 back into the cylindrical ball detent recess 120, compressing the tension element 147, and allowing the locking collar 130 to move to another rotational position relative to the muzzle device 110.

In various exemplary embodiments, the depth of the collar detents 139 varies. The larger or deeper of the collar detents 139 are positioned relative to the ultimate locked and unlocked positions. These positions will give the user the greatest tactile feel. The smaller or more shallow collar detents 139, positioned in between the two larger or deeper collar detents 139, provide tactile clicking points between the ultimate locked and unlocked positions.

A pin aperture 137 is formed through the barrel end 131 of the locking collar 130. The pin aperture 137 allows for installation of a pin 149 (such as, for example, a 1/16×0.250" roll pin) through and extending from the pin aperture 137. In various exemplary embodiments, the pin 149 may optionally comprise a cylindrical pin, a cylindrical pin dowel, a roll pin, a tension pin, a split pin, an expansion pin, or the like.

The pin 149 extends from the barrel end 131 through the collar shoulder 135 of the locking collar 130 and into the collar recess 136 of the locking collar 130. The pin 149 is positioned to ride within a pin channel 123 to stop additional rotation of the locking collar 130, beyond the ultimate locked and unlocked positions. In various exemplary embodiments, the pin channel 123 is milled into at least a portion of one of the muzzle device capture extensions 121 that extend from the muzzle device 110.

When the locking collar 130 is in the unlocked position, locking lug recess 115 formed in the muzzle device 110 align with lug recesses 138 formed in the locking collar 130, to allow the flanges 151 of the locking lug 150 to be positioned within a locking lug recess 115 of the muzzle device 110 mounting system. Once appropriately positioned, the locking collar 130 can be rotated to the locked position, wherein the lug recesses 138 formed in the locking collar 130 maintain the flanges 151 of the locking lug 150 within the locking lug recess 115 of the muzzle device 110 mounting system.

One or more holes or port apertures 118 are formed through the muzzle device 110, so as to line up with muzzle devices 110 designed for use in conjunction with the lockable muzzle device 110 mounting system 100. The port apertures 118 may be threaded or unthreaded.

During assembly of the muzzle device 110 mounting system, a tension element 147 and ball element 148 are positioned within each ball detent recess 120. The muzzle end 132 of the locking ring is aligned with the barrel end 111 of the muzzle device 110 such that the muzzle device capture extensions 121 are fitted within the locking collar aperture extension recesses 142 between each collar capture extension 143. In this manner, the muzzle device capture extensions 121 are positioned within the collar recess 136 of the locking collar 130. The locking collar 130 is rotationally aligned with the muzzle device 110 such that the pin channel 123 of the muzzle device 110 is aligned with the pin aperture 137 of the locking collar 130.

Once appropriately aligned, the pin 149 is positioned within the pin aperture 137, such that the pin 149 extends from the locking collar 130 and into at least a portion of the pin channel 123. In this manner, the ball elements 148 are able to extend into at least a portion of an aligned collar detent 139.

Figure 25:
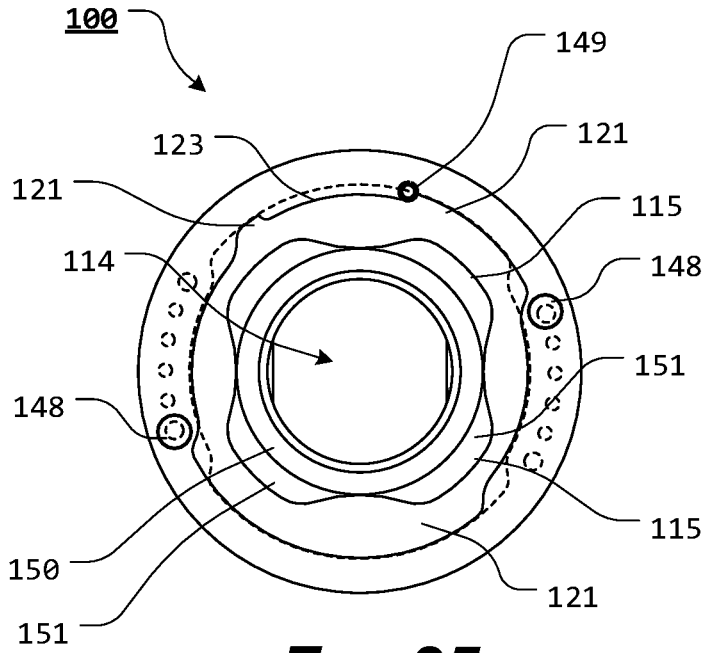
FIG. 25 illustrates a rear view of an exemplary embodiment of a lockable muzzle device mounting system, wherein the locking collar is in the unlocked position, according to the presently disclosed systems, methods, and/or apparatuses.
Figure 26:
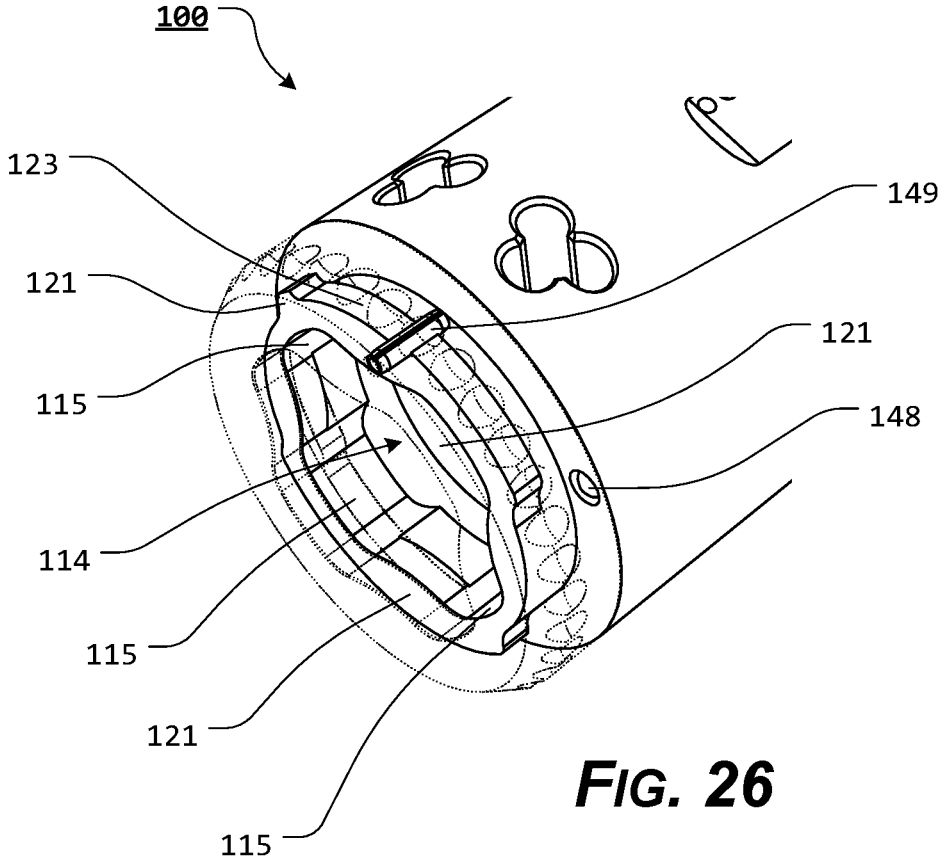
FIG. 26 illustrates a rear, perspective view of an exemplary embodiment of a lockable muzzle device mounting system, wherein the locking collar is in the unlocked position, according to the presently disclosed systems, methods, and/or apparatuses.
Figure 27:
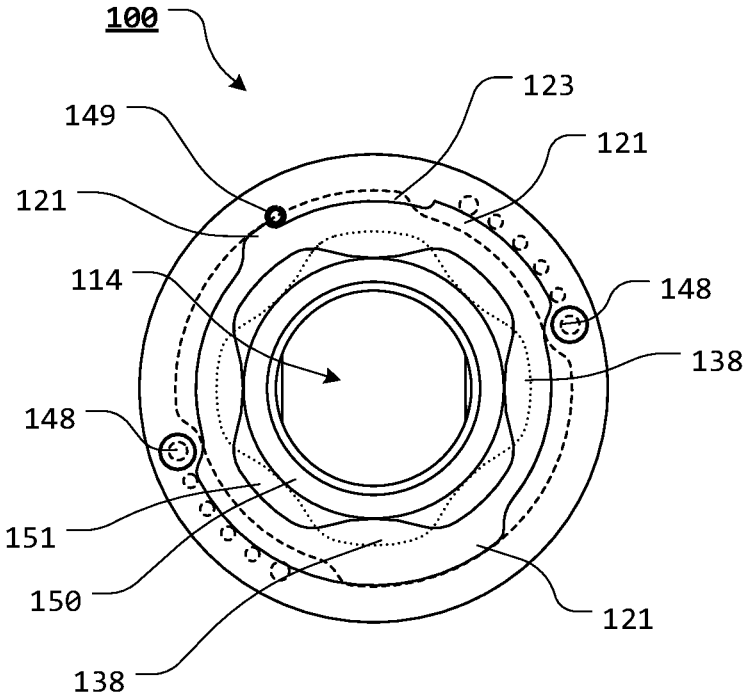
FIG. 27 illustrates a rear view of an exemplary embodiment of a lockable muzzle device mounting system, wherein the locking collar is in the locked position, according to the presently disclosed systems, methods, and/or apparatuses.
Figure 28:
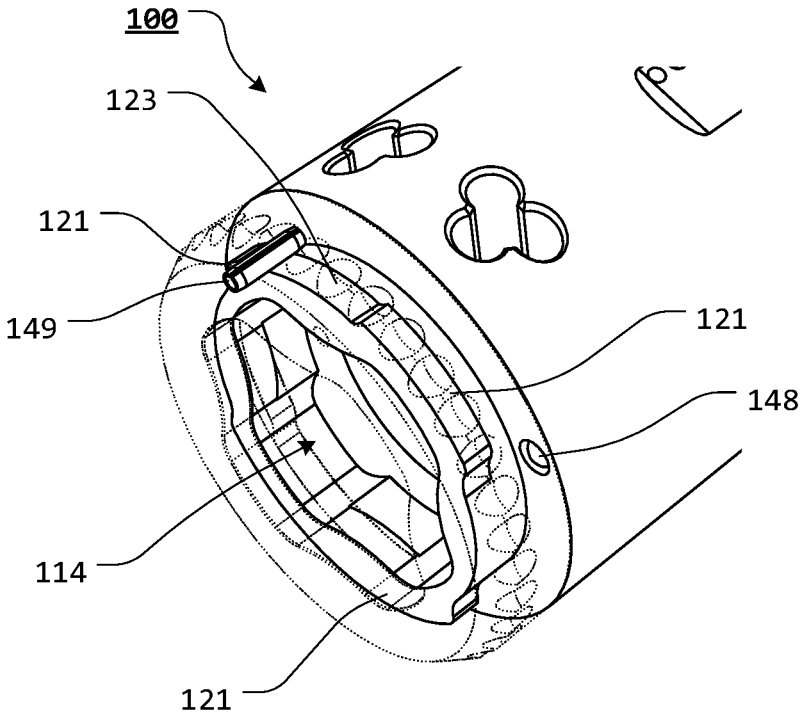
FIG. 28 illustrates a rear, perspective view of an exemplary embodiment of a lockable muzzle device mounting system, wherein the locking collar is in the locked position, according to the presently disclosed systems, methods, and/or apparatuses.
Figure 29:
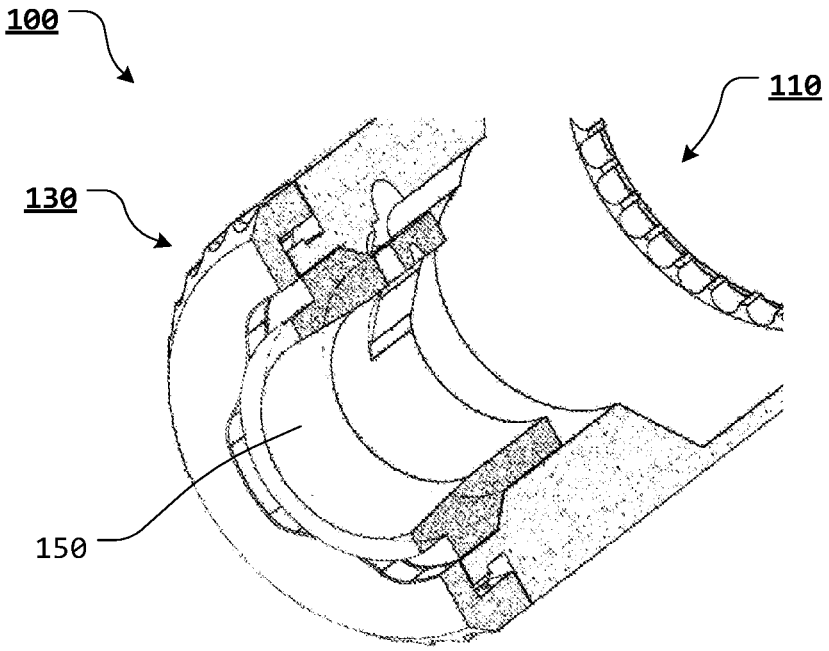
FIG. 29 illustrates a rear, cross-sectional, perspective view of an exemplary embodiment of a lockable muzzle device mounting system, wherein the locking collar is in the unlocked position, according to the presently disclosed systems, methods, and/or apparatuses.
Figure 30:
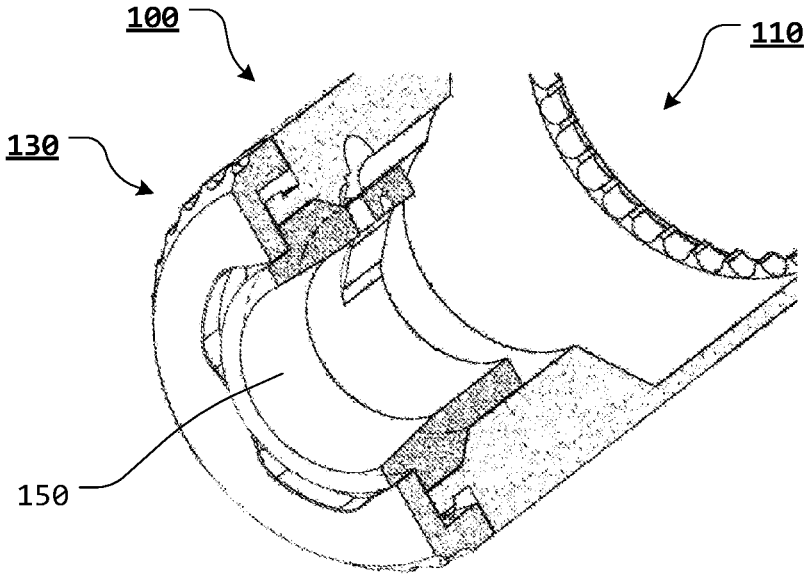
FIG. 30 illustrates a rear, cross-sectional, perspective view of an exemplary embodiment of a lockable muzzle device mounting system, wherein the locking collar is in the locked position, according to the presently disclosed systems, methods, and/or apparatuses.
Figure 31:
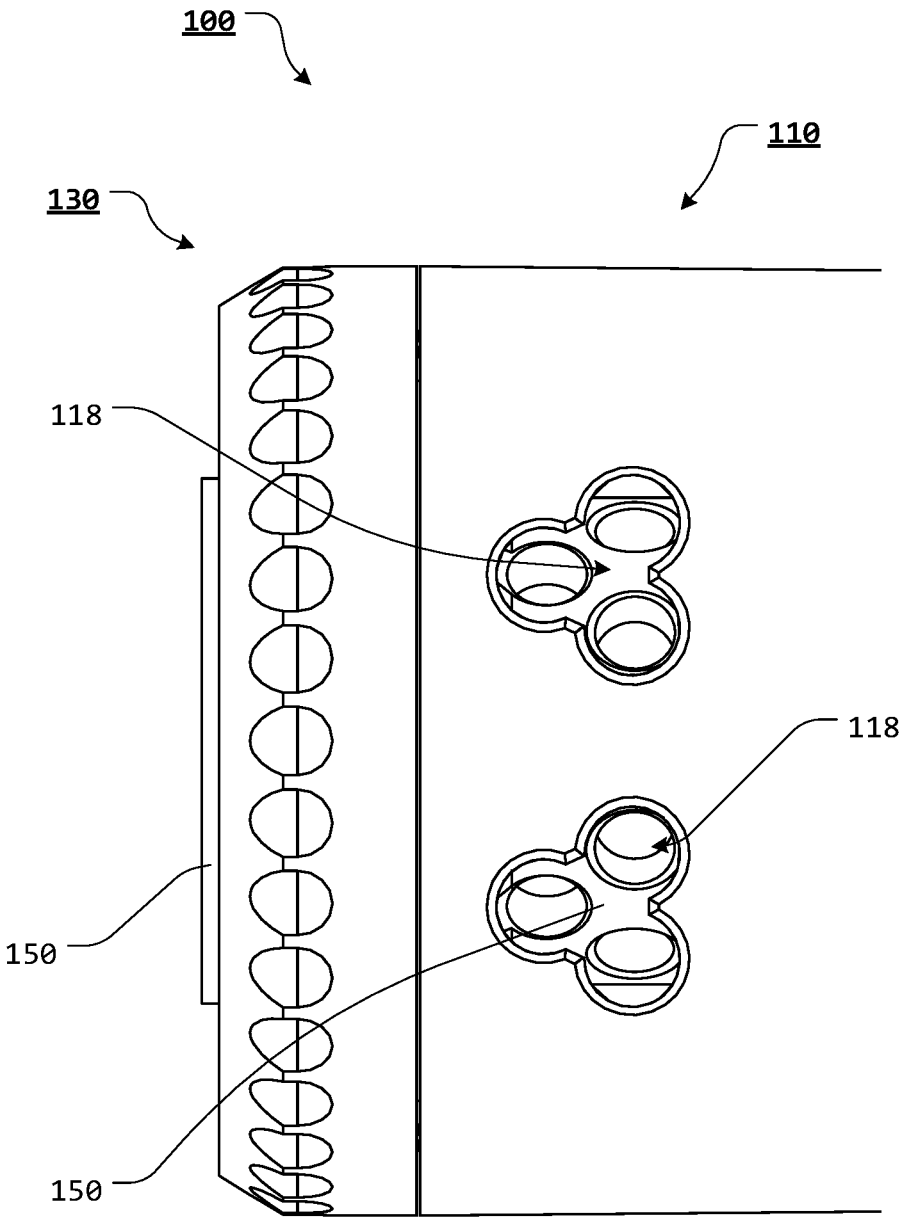
FIG. 31 illustrates a top, partial view of an exemplary embodiment of a lockable muzzle device mounting system, according to the presently disclosed systems, methods, and/or apparatuses.

Thus, the locking collar 130 can be rotated between an unlocked position, as illustrated in FIGS. 25 and 26, and a locked position, as illustrated in FIGS. 27 and 28.

When the locking collar 130 is in the unlocked position, lug recesses 115 formed in the muzzle device 110 align with lug recesses 138 formed in the locking collar 130, to allow the flanges 151 of the locking lug 150 to be positioned within a locking lug recess 115 of the muzzle device 110 mounting system. Once appropriately positioned, the locking collar 130 can be rotated to the locked position, wherein the lug recesses 138 formed in the locking collar 130 maintain the flanges 151 of the locking lug 150 within the locking lug recess 115 of the muzzle device 110 mounting system.

One or more holes or port apertures 118 are formed through the muzzle device 110, so as to line up with muzzle devices 110 designed for use in conjunction with the lockable muzzle device 110 mounting system 100. The port apertures 118 may be threaded or unthreaded.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A muzzle device mounting system, comprising:

a muzzle device having muzzle device locking lug recesses and having at least one ball detent recess formed in a portion of said muzzle device, wherein a tension element and a ball element are at least partially positioned within said at least one ball detent recess, and wherein a pin channel is formed within a portion of said muzzle device;

a locking collar having locking collar locking lug recesses and being rotatable relative to said muzzle device between a locked position and an unlocked position, wherein said locking collar includes a plurality of collar detents formed in a surface of said locking collar, wherein said collar detents are formed so as to interact with said at least one ball element; and a pin extending from said locking collar and into at least a portion of said pin channel to limit rotational movement of said locking collar relative to said muzzle device, wherein if said locking collar is in said unlocked position, said muzzle device locking lug recesses are aligned with said locking collar locking lug recesses and if said locking collar is in said locked position, said muzzle device locking lug recesses are not aligned with said locking collar locking lug recesses.

2. The muzzle device mounting system of claim 1, wherein said pin channel is an arcuate or partially arcuate pin recess or channel.

3. The muzzle device mounting system of claim 1, wherein said collar detents provide tactile rotatable locking positions between said locked and unlocked positions.

4. The muzzle device mounting system of claim 1, wherein a depth of at least some of said plurality of collar detents varies compared to a depth of at least some other of said plurality of collar detents.

5. The muzzle device mounting system of claim 1, wherein larger or deeper collar detents are positioned relative to said locked and unlocked positions.

6. The muzzle device mounting system of claim 1, further comprising a plurality of port apertures formed through a portion of said muzzle device.

7. The muzzle device mounting system of claim 1, further comprising a plurality of port apertures extending radially from a muzzle device aperture of said muzzle device, toward the outer surface of said muzzle device.

8. A muzzle device mounting system, comprising:

a muzzle device having muzzle device locking lug recesses having a tension element and a ball element at least partially positioned within at least one ball detent recess, and having a pin channel formed within a portion of said muzzle device;

a locking collar having locking collar locking lug recesses and being rotatable relative to said muzzle device between a locked position and an unlocked position, said locking collar having a plurality of collar detents formed in a surface of said locking collar, having said collar detents formed so as to interact with said at least one ball element; and a pin extending from said locking collar and extending into at least a portion of said pin channel to limit rotational movement of said locking collar relative to said muzzle device, such that if said locking collar is in said unlocked position, said muzzle device locking lug recesses are aligned with said locking collar locking lug recesses and if said locking collar is in said locked position, said muzzle device locking lug recesses are not aligned with said locking collar locking lug recesses.

9. The muzzle device mounting system of claim 8, wherein said pin channel is an arcuate or partially arcuate pin recess or channel.

10. The muzzle device mounting system of claim 8, wherein said collar detents provide tactile rotatable locking positions between said locked and unlocked positions.

11. The muzzle device mounting system of claim 8, wherein said pin comprises a cylindrical pin, a cylindrical pin dowel, a roll pin, a tension pin, a split pin, or an expansion pin.

12. The muzzle device mounting system of claim 8, wherein larger or deeper collar detents are positioned relative to said locked and unlocked positions.

13. The muzzle device mounting system of claim 8, further comprising a plurality of port apertures formed through a portion of said muzzle device.

14. The muzzle device mounting system of claim 8, further comprising a plurality of port apertures extending radially from a muzzle device aperture of said muzzle device, toward the outer surface of said muzzle device.

15. A muzzle device mounting system, comprising:

a muzzle device having muzzle device locking lug recesses having at least one ball detent recess, said at least one ball detent recess having a tension element and a ball element at least partially positioned therein, and having a pin channel formed within a portion of said muzzle device;

a locking collar having locking collar locking lug recesses and being rotatable relative to said muzzle device between a locked position and an unlocked position, said locking collar having a plurality of collar detents formed in a surface of said locking collar, having said collar detents formed so as to allow at least a portion of said at least one ball element to be selectively and removably positioned within at least a portion of at least one of said collar detents; and a pin extending from said locking collar and extending into at least a portion of said pin channel to bound rotational movement of said locking collar relative to said muzzle device, such that if said locking collar is in said unlocked position, said muzzle device locking lug recesses are aligned with said locking collar locking lug recesses.

16. The muzzle device mounting system of claim 15, wherein if said locking collar is in said locked position, said muzzle device locking lug recesses are not aligned with said locking collar locking lug recesses.

17. The muzzle device mounting system of claim 15, wherein said pin comprises a cylindrical pin, a cylindrical pin dowel, a roll pin, a tension pin, a split pin, or an expansion pin.

18. The muzzle device mounting system of claim 15, wherein larger or deeper collar detents are positioned relative to said locked and unlocked positions.

19. The muzzle device mounting system of claim 15, further comprising a plurality of port apertures formed through a portion of said muzzle device.

20. The muzzle device mounting system of claim 15, wherein said pin channel is an arcuate or partially arcuate pin recess or channel.

* * * * *